United States Patent [19]

Driscoll

[11] 4,210,487

[45] * Jul. 1, 1980

[54] PROCESS FOR MAKING SYNTHETIC PAPER PULP

[75] Inventor: Gary L. Driscoll, Boothwyn, Pa.

[73] Assignee: Sun Oil Company of Pennsylvania, Philadelphia, Pa.

[ * ] Notice: The portion of the term of this patent subsequent to Jun. 7, 1994, has been disclaimed.

[21] Appl. No.: 818,490

[22] Filed: Jul. 25, 1977

Related U.S. Application Data

[63] Continuation-in-part of Ser. No. 648,985, Jan. 14, 1976, abandoned, which is a continuation-in-part of Ser. No. 412,510, Nov. 2, 1973, abandoned.

[51] Int. Cl.[2] ..... D21H 5/12

[52] U.S. Cl. ..... 162/146

[58] Field of Search ..... 264/147.51, 126, 128, 264/DIG. 8; 162/146, 157 R

[56] References Cited

U.S. PATENT DOCUMENTS

| | | | |
|---|---|---|---|
| 3,403,203 | 9/1968 | Schirmer | 264/DIG. 8 |
| 3,634,564 | 1/1972 | Okamoto et al. | 264/DIG. 8 |
| 3,674,621 | 7/1972 | Miyamoto et al. | 162/146 |
| 3,730,830 | 5/1973 | Driscoll | 162/146 |
| 3,770,856 | 11/1973 | Uek et al. | 162/157 R |
| 3,795,575 | 3/1974 | Gouw | 162/146 |
| 3,954,928 | 5/1976 | Omori et al. | 264/DIG. 8 |
| 4,028,452 | 6/1977 | Driscoll | 162/157 R |

FOREIGN PATENT DOCUMENTS

| | | | |
|---|---|---|---|
| 1221488 | 2/1971 | United Kingdom | 264/DIG. 8 |

*Primary Examiner*—S. Leon Bashore
*Assistant Examiner*—Peter Chin
*Attorney, Agent, or Firm*—J. Edward Hess; Donald R. Johnson; Anthony Potts, Jr.

[57] ABSTRACT

Synthetic thermoplastic polymer fibers are prepared by extruding a foamed fibrillated sheet of a normally solid synthetic thermoplastic polymer, attenuating the molten foamed sheet as it is extruded and applying either a cutting and/or a shearing action to the solid attenuated sheet to cause it to break down into short fibers containing numerous fibrils. The polymer is polypropylene, polyethylene or a mixture of polystyrene and polypropylene or polyethylene in which the mixture contains more than 40 weight percent of the polyolefin. These short fibers can be blended with natural pulp. The resulting blend can be wet laid to form a coarse paper and then formed into a final paper product by application of heat and pressure. The resulting paper has certain superior properties.

1 Claim, No Drawings

PROCESS FOR MAKING SYNTHETIC PAPER PULP

CROSS REFERENCE TO RELATED APPLICATIONS

This application is a continuation-in-part of U.S. Patent application 648,985, filed Jan. 14, 1976, now abandoned which itself was a continuation-in-part of U.S. Pat. Application No. 412,510, filed Nov. 2, 1973, now abandoned.

BACKGROUND OF THE INVENTION

1. Field of the Invention

The useful process disclosed hereinafter is directed to making thermoplastic polymer fibers suitable for mixing with cellulosic pulp. The process is also directed to the mixing of the fibers with cellulosic pulp to make paper having improved properties. One example of a useful cellulosic pulp is bleached kraft paper.

2. Background Art

U.S. Pat. No. 3,770,856 discloses the production of fine fibrous structures by flashing an aqueous emulsion containing a polymer and solvent from a higher pressure and temperature zone to a lower pressure and temperature zone. The resulting structure is macerated in a mixer whereby obtained are fine flat fibers in a fibrillar state of an average width of from 5 to 10 microns and length of from 3 to 5 mm. The resulting fibers can be pressed into a synthetic paper.

British Pat. No. 1,221,488 discloses a process for the production of yarn which involves extruding a blend of polyethylene and blowing agent so as to produce an extrudate of foamed polyethylene. The latter is drawn so that it becomes orientated essentially in the direction of extrusion. The drawn foamed polyethylene is subjected to forces such that the walls of the foam are broken down. The resulting extrudate is a three-dimensional structure of interconnected fiber elements.

U.S. Pat. No. 3,634,564 discloses a process for the manufacture of fibrillated foamed films involving mixing a thermoplastic polymer with a blowing agent and extruding the mixture into a foamed polymer film and thereafter stretching the foamed film uniaxially. The stretching at an elevated temperature causes the voids of the foam to split.

The last two aforementioned patents disclose that the extrudate is orientated. Orientation refers to a process wherein the crystalline structure in polymeric materials are placed in alignment so as to produce a highly uniform structure. It is believed that orientation causes the axes of the molecules of the polymer to more generally line up in the same direction. Generally orientation is obtained by stretching (or pulling) the polymer while its temperature is below its melting point but above its transition temperature. But orientated extrudate, upon cutting and/or shearing into short fibers, does not yield suitable fibers for mixing with cellulosic pulp.

U.S. Pat. No. 3,954,928, discloses a process for the preparation of fibrillated extrudate by extruding a molten thermoplastic resin containing a foaming substance through a die. The extrudate is quenched almost as it leaves the die to a temperature below the resin's glass transition temperature. The resin can be a blend of polystyrene and a polyolefin e.g., polyethylene but the latter is present in an amount of at most 40% and preferably 30% or less by weight based on the blend.

Surprisingly applicant has found that a polyolefin by itself can be processed to fibers suitable for blending with cellulosic pulp. Equally surprisingly is that applicant has found that a mixture of polystyrene and polyethylene or polypropylene in which the mixture contains more than 40 weight % of the polyolefin is equally suitable for blending with cellulosic pulps.

SUMMARY OF THE INVENTION

The present invention relates to a process of preparing synthetic pulp from a synthetic thermoplastic, fiber-forming polymer. The resin is extruded along with a blowing agent to form material having interconnected fibrils and fibers. The material is attenuated as it leaves the extruder die to induce formation of fibers and fibrils. The attenuation occurs while the polymer is in a molten or amorphous state. The resulting fibrillated material is then subjected to a cutting and/or shearing action which results in the foamed material breaking down into small short fibers having many attached fibrils. This synthetic fibrous material readily mixes with cellulosic pulp to allow preparation of a paper sheet having varying amounts of the desired synthetic polymer. The resulting paper, depending on the particular polymer and the amount can have properties superior to that of paper of only cellulosic pulp. The synthetic thermoplastic polymer is selected from the group consisting of polypropylene, polyethylene or a mixture of polystyrene and polypropylene or polyethylene in which the mixture contains more than 40 percent by weight of the polyolefin.

This process has the advantage of being simple. Furthermore, in order for the synthetic fibers to be suitable for use in conventional paper making machinery this process allows for variation in fiber length, cross-section, composition and makes a fibrous structure having many fine fibrils to provide for good interconnection. In addition for this application the process is as economical as possible which helps keep the cost of the synthetic fibers (pulp) as close as possible to that of natural pulp.

DESCRIPTION OF THE INVENTION

The present invention involves extruding a foamable melt of normally solid synthetic thermoplastic polymer through a means to form a mass of interconnected fibers and fibrils which is attenuated and taken up on a suitable device.

The means used to form the mass can be a slot die which is either circular or flat. Practicality and convenience are the only limits to the width or diameter of the die. Generally the slot will be from 5 to 100 mils in thickness. Below about 5 mils the amount of material being extruded becomes so small as to be impractical. Above about 100 mils in thickness the sheet becomes increasingly difficult to attenuate and to break into fibers and the fibers become undesirably coarse.

The mass is attenuated as it leaves the die to induce fibril formation. Generally this attenuation is at a rate of from about 20 to about 200 times the rate linear at which the sheet is being extruded; preferred rates are from about 50 to about 150. This attenuation takes place while the polymer is still in the molten or amorphous state. The mass can have any one of the numerous shapes and be in almost any size. Such a mass can be referred to as a sheet. Attenuation refers to the stretching or pulling of the polymer while its temperature is generally above its melting point or the polymer is in an amorphous state.

The normally solid synthetic thermoplastic polymer suitable for use in this invention is polyethylene (low, medium or high density) or polypropylene including isotactic polypropylene or a mixture of polystyrene and polyethylene or polypropylene in which the mixture contains more than 40 percent by weight of the polyolefin. Fibers with more than 60 percent by weight of polystyrene show poor properties when exposed to an elevated temperature or a solvent. These poor properties can adversely affect the properties of the resulting paper when the fiber is used admixed with cellulosic pulp.

The optimum conditions used can vary considerably depending on the choice of the polymer system. The length and diameter of the fibers can be in part controlled by varying the amount of blowing agent used, the temperature both in the extruder and of the quench, the polymer through-up rate through the extruder and die, the amount of attenuation achieved by means of the take off rate and the geometry of the die-take-off system.

The extruder can be equipped with a port to inject the blowing agent. If this is done, various blowing agents may be used such as the various Freons$^R$, methylene chloride, nitrogen, carbon dioxide, water, etc. If the extruder is not equipped with a port to inject the blowing agent the blowing agent is fed into the extruder along with the resin being extruded. While this can be done by coating the resin pellets or powder with a low boiling liquid such as pentane which becomes a gas in the extruder, it is preferred to blend a solid physically or chemically decomposable blowing agent with the resin and then to feed the resulting blend into the extruder Exemplary chemical agents include but are not limited to azobisformamide, azobisisobutyronitrile, diazoaminobenzene, 4,4-oxybis(benzenesulfonylhydrazide), benzenesulfonylhydrazide, N,N'-dinitrazopentamethylenetetramine, trihydrazinosymtriazine, p,p'-oxybis(benzenesulfonylsemicarbazide)-4-nitrobenzene sulfonic acid hydrazide, beta-naphthalene sulfonic acid hydrazide, diphenyl-4,4'-di(sulfonylazide) and sodium bicarbonate or mixtures of sodium bicarbonate or sodium carbonate with a solid acid such as tartaric acid. The amount of foaming agent used in the process generally is in the range of from 0.1 to 20 wt.% of the resin being extruded with from 0.1 to 5.0 wt.% being the preferred range.

The attenuated fibrous sheet is then broken down into fibers. One way of accomplishing this is to feed the fibrous sheet against a hot air blast which pulls the fibers apart. Another technique involves applying a shearing action to the fibrous sheet to break the fibrous sheet down into fibers. This is most easily accomplished by placing portions of the fibrillated sheet in a liquid which is being violently agitated such as by rapidly rotating paddles.

In order to better control the fiber length, it is preferable to use a mechanical cutting step. A "flock" cutter as is used in the textile industry are suitable for this step as are plastic granulators of suitable design. The aforementioned cutter is a mechanical cutter designed to cut fibers to uniform lengths and thereby permit the fibers to be used, for example, in blankets by electrostatic deposition on polyurethane foam. For most applications a cut length of ⅛" to 3/16" is most suitable, while for specialty application, longer or shorter fibers could be preferable. In addition to cutting some shearing may enhance the utility of the fibers.

It is preferable to use standard papermaking processing to accomplish the sheet break-down to fibers containing fibrils. Standard pulp defibering equipment can be used. With control of the volume and temperature of the water used, it is possible to grind the cut polymeric material alone. It is, however, preferable to blend the cut sheet with natural pulp and feed the mixture to the mill to accomplish both the blending and defibering operation simultaneously. Chemicals such as starch or polyethyleneimine can be added to the mixture before grinding to improve dispersion and ultimate paper properties.

The fibers can be used directly to form paper. However, the resulting product is generally more expensive than is desired for most uses to which paper is applied. Generally the synthetic pulp produced in accordance with the present invention is blended with from 10 to 90 wt.% of natural cellulosic pulp or other cellulosic materials such as bleached kraft paper fibers, and then laid to form a paper. The coarse wet laid material finds use as filter paper, paper towels, etc. However, it is preferred that the coarse wet laid paper be subjected to the application of heat and pressure in order to improve the strength and surface finish thereof. For individual paper sheets a press operated at from 10 to 500 p.s.i. and 50° to 150° C. for from 0.2 sec. to 5 minutes is satisfactory. For long rolls of paper heated pressure rolls are used. Generally, these are heated metal rolls such as heated steel rolls operated at from 2 to 200 lbs. per linear inch pressure, from 50° to 150° C. and the paper is fed at a rate of from 10 to 1500 feet per minute.

The product paper finds use in the applications to which conventional paper finds use such as writing paper, bagging, packaging, wallpaper, etc. However, the paper produced in accordance with the present invention finds its greatest advantage over conventional paper in the packaging area due to its improved wet strength and heat sealability and in printing papers where its high whiteness and smoothness are important.

The present invention will be further explained with reference to the following examples.

EXAMPLE I

A one inch Killian extruder having a length to diameter ratio of 24:1 was equipped with a screw having a two-stage mixing head. Temperatures were measured at four points on the extruder. These were: (A) entry point of polymer pellets; (B) at the midpoint of the screw; (C) near the mixing head and (D) at the die. The die was an 8 inch slot set at 0.020 inch opening. The quench was at room temperature, air stream impinging on both sides of the fibrous sheet at about one inch from the die lips. The resulting fibrous sheet was passed through a pair of rolls to maintain the rate of take off and was then wound up on a paper core. The mixture being extruded was prepared by shaking together 500 g. of polypropylene having a melt index of 10 and 500 g. of Dow Styron polystyrene (general purpose U 660) pellets having a melt index of 5 and 20 g. of anhydrous sodium bicarbonate powder. The temperature along the various points along the extruder were: (A) 250° F.; (B) 350° F.; (C) 450° F. and (D) 450° F. The throughput was at the rate of 7 lbs. per hour and the fibrous sheet was taken up at the rate of 35 ft. per minute. The attenuation ratio was at about 22 to 1. The ratio was not precisely known because density of the mixture was not known at exiting temperature and die gap was not known perfectly at operating temperature and pressure. The foregoing were not large but make ratios uncertain by an estimated ±10%.

A 2.5 g. sample of the fibrous sheet structure and 750 ml. of water were placed in a two-speed commercial type Waring blender. The blender was operated at high speed for 10 minutes. A blender both cuts and shears. Shearing is different from cutting in that it means pulling fiber lengthwise apart whereas cutting means determining the length of the fibers. Then 7.5 g. of bleached kraft paper was added to the blender and the blender was operated at high speed for an additional 10 minutes. The resulting mixture was poured into a suction filter about 6 inches in diameter to remove the water, pressed with a flat surface and air dried for a few minutes. The resulting coarse paper was then removed and dried further. The paper was then pressed at 250° F. and 40,000 lbs. pressure between metal plates for 0.5 minutes for additional bonding. The product was a smooth white paper which could be written on with both pen and pencil, and had qualitatively good strength. The paper exhibited exceptionally good wet strength.

EXAMPLE II

Example I was repeated except that 500 g. of low density polyethylene having a specific gravity of 0.95 and a melt index of 5 was substituted for 500 g. of the polypropylene to provide a 50:50 blend of polyethylene and polystyrene. The take off rate from the extruder was reduced to 20 feet per minute and the pressing temperature of the mixture was 215° F. The throughput was at about 2.5 lbs/hour and the attenuation ratio was at about 40 to 1. The product paper had a smooth white appearance. It could be written on with pen or pencil and had qualitatively good strength both wet and dry.

EXAMPLE III

Example I was repeated except that 1000 g. of polypropylene having a melt index of 10 was substituted for the 50/50 mixture and except that the pressing temperature of the mixture was 275° F. The product paper had a smooth white appearance. It could be written on with pen or pencil and had qualitatively good strength both wet and dry.

EXAMPLE IV

Example I was repeated with the following exceptions: polypropylene (Profax 6323, melt index about 15) was used instead of the 50/50 mixture; the first heater was at 350° F., the second at 400° F.; the throughput was 5 lbs/hours; and the take off rate was 90 ft./min. Under these conditions, the attenuated ratio was about 70 to 1.

EXAMPLE V

Example IV was repeated using a take off rate of 130 ft./min. Under these conditions the attenuation ratio was about 100 to 1.

EXAMPLE VI

The sheets from Examples IV and V were cut on a mechanical cutter (helical shearing action). Various screens were used with ⅛" giving the most suitable material. Cutting was done dry from rolls. The product air conveyed well.

EXAMPLE VII

The cut products from Examples IV and V were defibered on a pulp mill. It was necessary to use larger than normal quantities of cold water to prevent fusion when only synthetic material was added. When synthetic material was mixed at 10 to 50% levels with kraft pulp board (dry), no difficulty was experienced in running the material under normal Kraft conditions. The resulting pulp was adequately wet for dispersion even without additives. Small hand sheets were prepared. These were smooth, white (for bleached Kraft) sheets that resembled ordinary paper in appearance. Examination showed that improved dispersion (from chemical additives) would be desirable for many applications. Tensile strengths were lower and opacities higher for the samples containing synthetic pulp. Properties such as heat-sealability or plastic forming require 25–50 weight % of the synthetic pulp. Retention of strength under conditions of high humidity was improved. The dry tensile strength was about 75% of a control Kraft paper sample while the wet tensile strength was about 200% of the control.

Other methods of cutting, such as mechanical cutting, will yield equally suitable synthetic fibers.

The invention claimed is:

1. A process for preparing synthetic paper comprising:

(a) heating a blend consisting essentially of a synthetic thermoplastic polymer wherein the polymer is a mixture of polystyrene and polypropylene or polyethylene in which the mixture contains more than 40 percent by weight of the polypropylene or polyethylene and the blend contains from about 0.1 to about 20 percent weight of sodium bicarbonate and whereby a molten blend is formed;

(b) extruding the molten blend from a die into a zone of reduced pressure to produce an extrudate;

(c) attenuating the extrudate while the polymer is in its molten or amorphous state with the attenuation caused by withdrawing the extrudate from the die at a linear rate of from about 20 to about 200 times the linear ratio at which the blend reaches the lips of the die;

(d) subjecting the attenuated extrudate, which is now fibrous and solid, to sufficient force to cause the extrudate to break into fibers suitable for mixing with cellulosic pulp; and (e) the resulting fibers, in an amount of about 10 to 50 weight % of the total weight, are mixed with bleached kraft paper fibers laid out in a sheet and formed into a paper by application of heat and pressure.

* * * * *